US006086270A

United States Patent [19]

Earle et al.

[11] Patent Number: 6,086,270

[45] Date of Patent: Jul. 11, 2000

[54] PROCESSING PHOTOGRAPHIC MATERIAL

[75] Inventors: Anthony Earle, Harrow Weald; Leslie R. Wells, Brentford; Henry H. Adam, Linslade, all of United Kingdom

[73] Assignee: Eastman Kodak Company, Rochester, N.Y.

[21] Appl. No.: 09/167,110

[22] Filed: Oct. 6, 1998

[30] Foreign Application Priority Data

Oct. 9, 1997 [GB] United Kingdom ..... 9721468

[51] Int. Cl.[7] ..... G03D 3/08; G03D 3/02; G03D 13/00

[52] U.S. Cl. ..... 396/617; 396/622; 396/626; 396/636

[58] Field of Search ..... 396/617, 620, 396/622, 624, 626, 627, 599, 628, 633, 636

[56] References Cited

U.S. PATENT DOCUMENTS

| | | | |
|---|---|---|---|
| 3,710,703 | 1/1973 | Bruno et al. | 396/618 |
| 4,178,089 | 12/1979 | Spence-Bate | 396/624 |
| 4,690,535 | 9/1987 | Kubota et al. | 396/622 |
| 4,929,975 | 5/1990 | Shidara | 396/626 |
| 5,365,300 | 11/1994 | Wernicke et al. | 396/617 |
| 5,510,870 | 4/1996 | Kashino et al. | 396/617 |
| 5,541,700 | 7/1996 | Earle et al. | 396/630 |
| 5,579,076 | 11/1996 | Calisto et al. | 396/627 |
| 5,923,916 | 7/1999 | Piccinino, Jr. et al. | 396/626 |

OTHER PUBLICATIONS

Patent Abstracts of Japan, vol. 14, No. 274 (P–1061), Jun. 13, 1990 & JP 02 079841 A (Konica Corp.), Mar. 20, 1990.

*Primary Examiner*—D. Rutledge
*Attorney, Agent, or Firm*—Frank Pincelli

[57] ABSTRACT

Apparatus for processing photographic material has a plurality of stages for carrying out different processing steps. At least one stage has a series of processing regions each defined by an inclined surface that extends between sets of rollers. The surfaces may be of different length to provide different residence times for the material. Processing solution flows down the surfaces whilst the photographic material is driven upwards in counter-current mode. All the stages may be uni-directionally inclined end-to-end, or they may be arranged in a U-shape so as to minimize cross-contamination between the stages.

23 Claims, 4 Drawing Sheets

PROCESSING PHOTOGRAPHIC MATERIAL

FIELD OF THE INVENTION

This invention relates to the processing of photographic material, usually already exposed, in which the material passes through a plurality of stages, preferably in a counter-current mode.

BACKGROUND OF THE INVENTION

Photographic material as referred to herein is understood to be generally planar, may comprise film or paper, may produce a black-and-white or color image, and may be in a continuous web form or may comprise discrete sheets.

Silver halide photographic materials are well-known, and are processed to generate a silver or dye image via a development stage followed by a series of baths to stabilize and provide permanence to the image. Such baths convert and remove unwanted materials from the coated photographic layers which would either interfere with the quality of the final image or cause degradation of the image with time. In typical color systems the development stage is followed by a bleach stage to oxidize the developed silver to a form which can be dissolved by a fixing agent in the same or a separate bath. Such silver removal stages are then followed by a washing stage using water, or other wash solution, or a stabilization stage using a stabilizer solution. For convenience, this last-mentioned stage will hereinafter be referred to generically as "washing." Such stages remove residual chemicals and may also include conversion reactions between stabilizer solution components and materials within the coated layers. These stages are required to provide the required degree of permanence to the final image.

In many cases, particularly in small-scale "minilab" or "microlab" equipment, the processing stages are performed in multi-tank arrangements. Usually the replenishment, which keeps the concentration of substances removed from the photographic material at a constant and sufficiently low level, is carried out by adding fresh solutions. Over-flow from the tanks can be arranged to flow into a previous tank and so on, the overflow from the first tank of the stage being then discarded as effluent. This is referred to as a "counter-current" mode. This arrangement allows significantly lower amounts of solution to be used compared with one or two tanks especially when these are replenished separately, especially in the washing stage.

In all of these arrangements, processing is carried out with the photographic material immersed in a tank of solution, even though many, though not all, photographic materials are sensitized with an emulsion only on one side thereof.

In a modern minilab a typical wash replenishment system might use around 200 $cm^3$ of replenisher per $m^2$ of sensitized material processed in a three or four-tank counter-current arrangement. The time the processed material spends in each tank is typically 20 to 25 seconds during which time an equilibrium is established between the concentration of substances in the coated material and the seasoned (steady-state) concentrations in the wash solution. The total time for this stage typically varies from 60 to over 100 seconds.

U.S. Pat. No. 5,365,300 discloses a process for the treatment of photographic material with a bath containing at least one processing material, in which, after the treatment bath, the photographic material is guided upwards through an ideally preferably vertical compartment which closely surrounds the material which is washed from above by water flowing under gravity in counter-current to the material. The wash water is arranged to carry chemicals off the material into the bath for re-cycling.

It is desirable to process photographic material more rapidly, and in particular to reduce overall wash times by several factors, for example to about 20 seconds as compared to 100 seconds, whilst reducing overall replenishment rates. Reduction of the path-length of the wash section of the process, for example, will shorten the time taken, for a given transportation speed of the material being processed. This latter parameter is usually constrained by the demands of the previous tanks. Unfortunately, simply reducing the number of counter-current tanks involved, while achieving the goal of shorter path-length, would require a significantly increased replenishment rate to achieve the same seasoned concentration (steady-state concentration) in the final tank from which the sensitized material emerges before being introduced to the drying stage.

It is also desirable to minimize the effluent from the processing. This is advantageous not only for the protection of the environment, but also to the operator, especially of mini- and micro-labs, in terms of having less solution for disposal.

Furthermore, it is desirable to provide simpler and more robust processing equipment.

SUMMARY OF THE INVENTION

The present invention provides multi-stage photographic processing apparatus that is arranged to overcome, or at least to alleviate, problems associated with known apparatus.

In accordance with one aspect of the present invention, there is provided apparatus for processing photographic material, comprising:

a plurality of processing stages, wherein at least one of the stages comprises at least one processing region defined by a surface inclined to the horizontal and disposed between a spaced-apart pair of guide means arranged to direct the material through the region over the inclined surface; and means for supplying different processing solution to each of the stages, wherein in the or each processing region, the solution is arranged to be applied to the inclined surface beneath the material to be processed.

Each of the said stages may comprise at least one of the said processing regions.

The surfaces in all of said processing regions may be inclined uni-directionally, that is to say to the horizontal, and preferably all at substantially the same angle. The angle of inclination of the surface to the horizontal is preferably between about 10° and 80°, more preferably between about 30° and 50°, and most preferably is between about 40 ° and 45°. Alternatively, the surfaces of at least two of the stages may be inclined to the horizontal in opposite senses. In the latter embodiment, the apparatus may present a substantially V-configuration, or there may be an intermediate stage or processing region that is disposed substantially horizontally such that the apparatus presents a substantially U-configuration.

Processing solution may flow down an inclined surface under gravity, and may then be recirculated, by a pump for example, to the beginning of that or of another region.

Advantageously, the photographic material and the processing solution flow in opposite directions, at least in some of the regions or stages.

Preferably in at least one of the stages, the length of the inclined surface is longer in the final processing region in the direction of movement of the material than in any one of the preceding regions of that stage.

The inclined surface in at least one of the processing regions may be substantially planar, or alternatively, it may be curved, for example such that the photographic material is immersed in the solution therein. The inclined surface is preferably textured so as to provide agitation of the processing solution, to ensure efficient reaction with the material.

In accordance with another aspect of the present invention, there is provided a method of processing photographic material, which may already be exposed, wherein the material is guided through a plurality of processing stages in each of which the material is subjected to a different processing solution, wherein in at least one of the stages the material is moved through at least one processing region defined by a surface inclined to the horizontal and disposed between a spaced-apart pair of guide means that urge the material on to the processing solution flowing over the inclined surface.

The method is preferably carried out using the apparatus of the invention, and preferably involves a wash stage, as well as one or more stages to develop, bleach, fix, or bleach-fix in a single stage, the photographic material.

Advantageously, in at least one stage, and preferably in the wash stage, the material resides in at least one of the processing regions for a time that is different from the time it resides in at least one other of the regions. This has been found to allow for significantly reduced processing times. The different residence times in the regions are preferably arranged by moving the material at a substantially constant speed over processing surfaces of the regions having different lengths.

The invention provides for effective photographic processing in a much reduced time.

Thus it is possible to devise an apparatus with very short residence times per tank, typically less than 10 seconds, and preferably less than 5 seconds, providing sufficient tanks are used. Thus, for example, both overall short process times for the wash step, less than the conventional 100 seconds, preferably less than 50 seconds, and even less than 25 seconds, as well as reduced replenishment rates can be obtained. The steady-state seasoned concentration of residual chemicals in the final wash tank may be as low as, or lower than, that achieved in a conventional counter-current system. By careful selection of the number of non-equilibrium stages and the time spent in each, it has been found that very large reductions in total wash times can be combined with significant reductions (50% or more) in replenishment rates, when compared with typical current methods. It is possible to achieve these significantly lower over-all wash times whilst maintaining efficient washing and low effluent volumes. By applying this to other stages, say to the development stage, much reduced overall processing times can be obtained for the photographic material.

It will be appreciated that exchange of solution between that contained within the stage and that in the material itself is primarily by a process of diffusion, so that complete equilibrium would occur in an exponential manner only after an infinite time.

The ability to vary the time spent in successive processing stages, by having inclined surfaces of different lengths for example, avoids the need for a buffer storage between different stages, or the need to vary the chemical activity between the stages, or to vary the speed of transport of the material, when in discrete sheet form.

When small quantities of processing solution are used, evaporation can present a significant problem. With the present invention, however, this can be minimized when, as in preferred embodiments, the emulsion side of the photographic material is arranged to face the surface of the stage through which it is transported. In this way, the material itself acts as a cover to reduce evaporation of the solution.

A photographic processor in accordance with the invention can be of simple construction, using shallow trays that cascade into one another, and can be easily transported and set up, without the requirement of sophisticated support systems. Drive for the photographic material through the apparatus can be provided with a minimal number of rollers.

Reference is made to related commonly-owned co-pending applications disclosing other aspects of photographic processing, filed contemporaneously herewith under U.S. Ser. No. 09/167,611, entitled PROCESSING PHOTOGRAPHIC MATERIAL, by Henry H. Adam et al, filed Oct. 6, 1998: U.S. Ser. No. 09/167,204, entitled PROCESSING PHOTOGRAPHIC MATERIAL, by Henry H. Adam et al, filed Oct. 6, 1998; and U.S. Ser. No. 09/167,201, entitled PROCESSING PHOTOGRAPHIC MATERIAL, by Henry H. Adam et al, filed Oct. 6, 1998.

BRIEF DESCRIPTION OF THE DRAWINGS

Apparatus for, and methods of processing photographic material, each in accordance with the present invention, will now be described, by way of example, with reference to the accompanying drawings, in which.

DETAILED DESCRIPTION OF THE INVENTION

Figure 1:
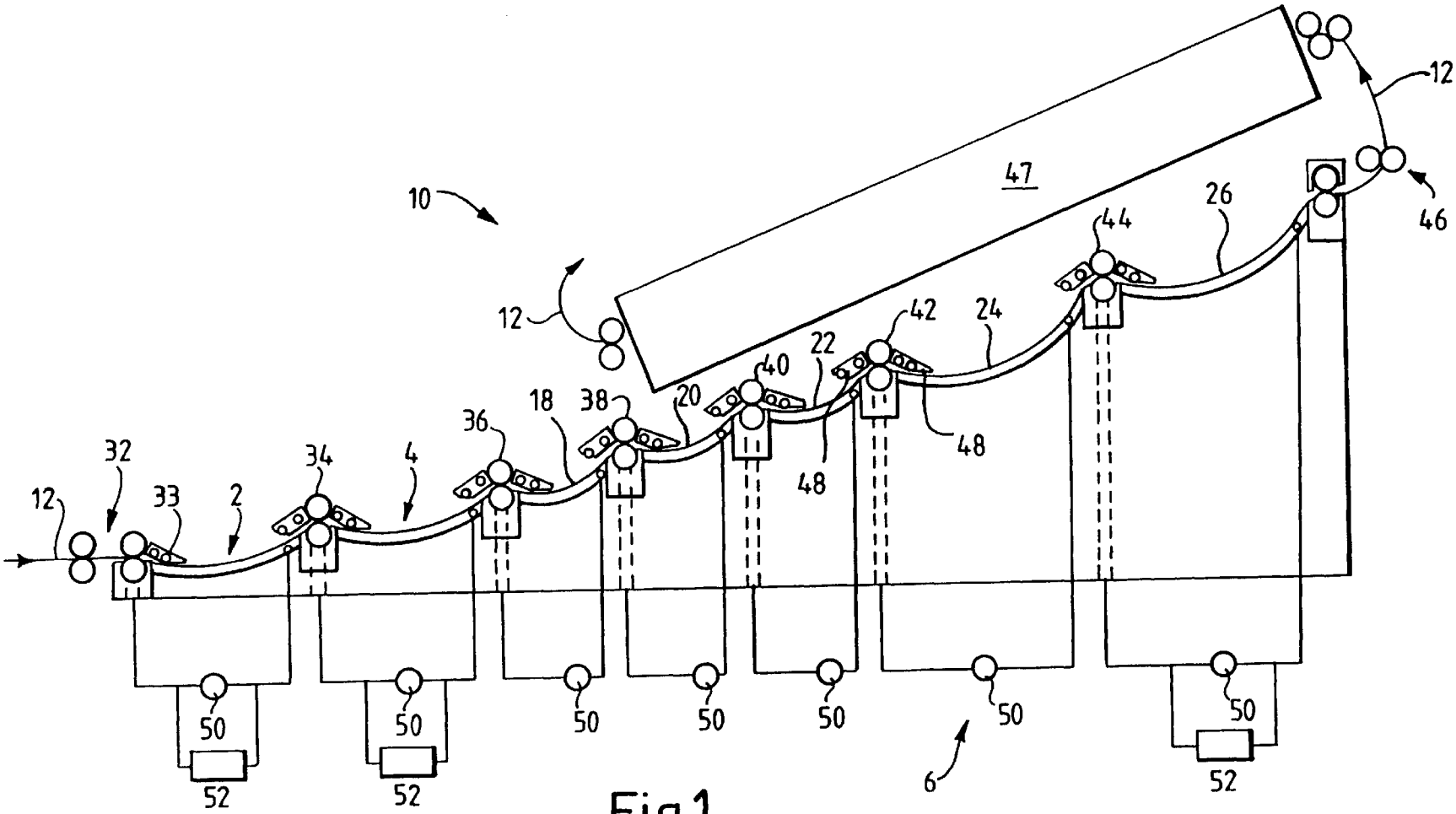
FIG. 1 is a schematic elevation of a first embodiment of the apparatus.

Referring to FIG. 1, the apparatus 10 is arranged to carry out processing of a continuous strip of exposed photographic film 12. The film 12 passes through a developing stage 2 and a combined bleaching and fixing stage 4 before entering a multi-region wash stage 6. The apparatus 10 has seven stages in total, comprising the initial shallow developing stage 2, the shallow bleaching and fixing stage 4 followed by a sequence of wash stages 18,20,22,24 and 26 that are inclined uni-directionally, upwards as shown, at 45° to the horizontal. Water for washing the film 12 enters the apparatus 10 only through an inlet (not shown) in the top stage 26, and flows under gravity down through the other stages 24 to 18. From there it may pass into an overflow outlet 30, or could be allowed to enter the bleach-fixing stage 4 before being removed together with the effluent therefrom.

Each stage 2, 4 and 18 to 26 is defined by an inclined surface and a set of rubber-covered rollers at each end thereof. The film 12, with its emulsion side downwards, enters at the bottom of the apparatus 10 through a set of rollers 32 and guide 33 that drive and guide the film down into the developer solution in the first stage 2. The film 12 is then guided into the nip of the next pair of rollers 34 and is immersed in the combined bleach and fixing solution in the stage 4. From there, the film 12 is guided onto the inclined surface of the first region 18 of the wash stage 6, down which the wash solution is flowing. The film is thus guided and transported up the apparatus 10 passing successively through sets of rollers 36,38,40,42 and 44 and associated guides of the wash stages 18 to 26. At the upper end of the apparatus, the film 12 is removed by and guided through a further roller arrangement 46 and then through a suitable drying stage 47, employing hot air, for example.

It will be appreciated that the film 12 will be immersed in solution in the initial portion of the wash stages 18 to 26 such that each of its sides will be washed. This is useful when the preceding stage 4. Most, but not all, photographic materials are sensitized only on one surface, however, so that immersion may not be required throughout the processing. As the film 12 progresses upwards through each successive inclined stage, it is substantially only the underside that is treated. In the present arrangement, the guiding of the film 12 over the inclined surfaces by the rollers may be enhanced by the adjacent guide plates 48 which are positioned and shaped to ensure that the film is urged towards the surfaces. The counter-flowing processing solution then forms a thin layer over which the film 12 is transported, thus ensuring effective washing.

Some processing solutions have hydrophobic properties, and to encourage a capillary action between the solution and the material to be processed, a thin cover of plastics material may initially be placed over the surfaces, or at least over the first surface of a stage, with the photographic material subsequently being fed underneath.

The film 12 is transported through the apparatus at a substantially constant speed. In order to achieve different residence times in the various stages, especially in the wash stages 18 to 26, the inclined surfaces are made of appropriately different lengths. The length of inclined surface in the final wash stage 26 is arranged to be long enough such that chemical equilibrium is achieved there between the concentration of the solution on the photographic material 12 and on the inclined surface.

As can be seen, one of each set of rollers 32 to 44, at the beginning of each stage, is counter-sunk in a channel that forms a reservoir for the processing solution flowing down the inclined surfaces. The solution is picked up from the reservoirs on the roller surfaces and is transferred to the film 12 as it moves upwardly through the nips. In this way, the film 12 is substantially constantly in contact with the solution from the time it enters the apparatus through rollers 32 until it leaves the top of uppermost stage 26. In other words, the cross-over time between each stage is substantially zero.

The processing solution, especially in the wash regions, may be transported up the inclined surfaces by being dragged along with the photographic material. It may also accumulate at the bottom of each region, overflowing downwards to the preceding stage. It is envisaged, however, that recirculating pumps 50 may be utilized to move the solution from the lower to the upper end of one or more of the stages. Furthermore, at least in the developing stage 2 and bleach-fixing stage 4, replenishment with fresh solution may be provided by metering devices or other pumps 52.

It is preferred, however, that all the wash solution from the wash stages and the solution from the developer stage is fed into the bleach-fix stage 4, which can then provide the sole outlet from the entire apparatus.

Figure 2:
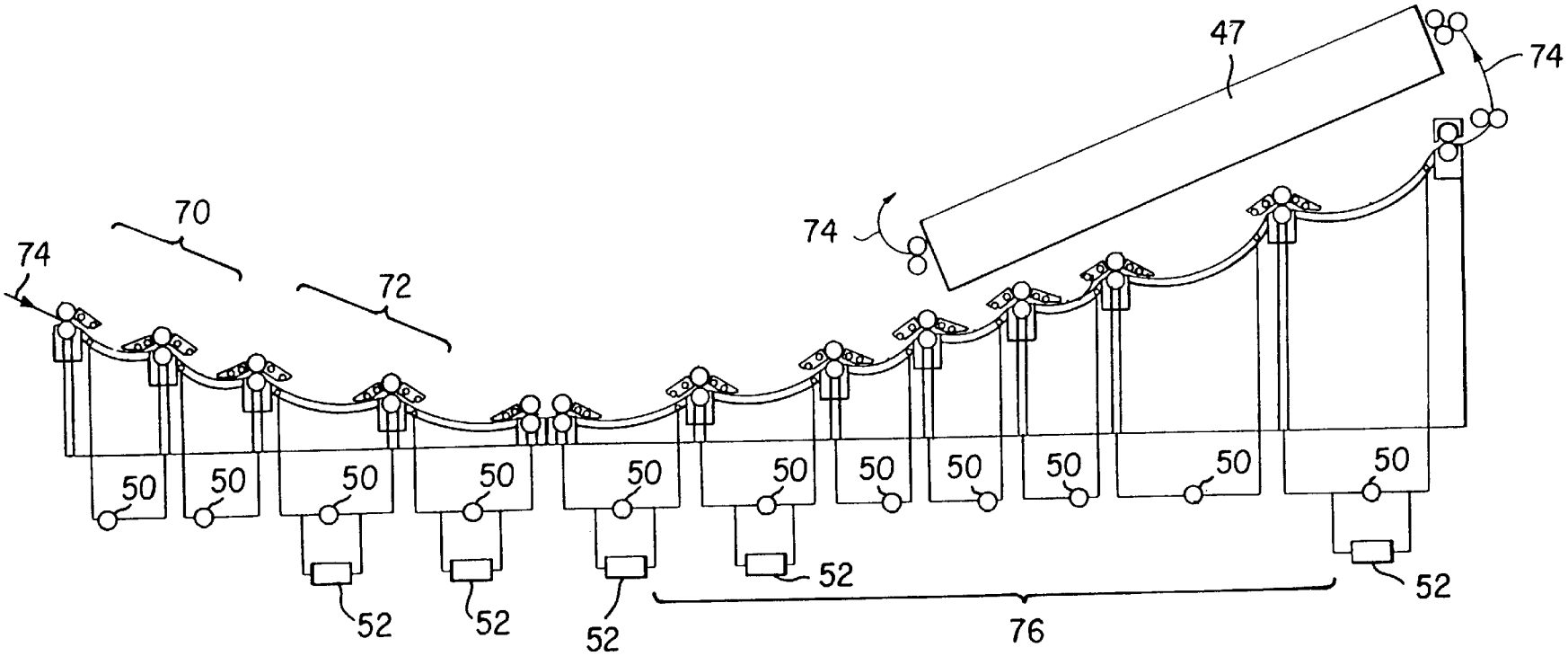
FIG. 2 is a schematic elevation of a second embodiment of the apparatus.

FIG. 2 shows an alternative embodiment of the apparatus, in which the developing stage 70 and the bleach-fix stage 72 are arranged such that the web 74 of photographic material passes therethrough in a downwards direction and then turns upwards to pass through the wash stage 76. This arrangement has the advantage that contamination of the solution in the development stage 70 by any overflow from the bleach-fix stage 72 is effectively prevented. It also allows a co- or counter-current flow of solution as required in these two stages.

As seen in FIG. 2, this embodiment provides two processing regions in each of the developer stage 70 and bleach-fix stage 72. In each region, rollers and a guide provide a nip and drive the web 74 down into the first part of each processing tray to immerse the photographic material 74. The web 74 the slides, emulsion side downwards, around the bottom of the tray and up out of the solution. It continues sliding along the surface and the solution is spread out across the web and the tray due to capillary action. The closeness of the web 74 and the tray surface ensures that the thin layer of solution is agitated by the action of the liquid flow and web movement. The wash stage 76, with seven regions shown, provides a cascade of clean wash solution to contact the web 74, as described above.

It is to be understood that the embodiment of FIG. 2 otherwise has the same or corresponding features as that of FIG. 1.

Figure 4:
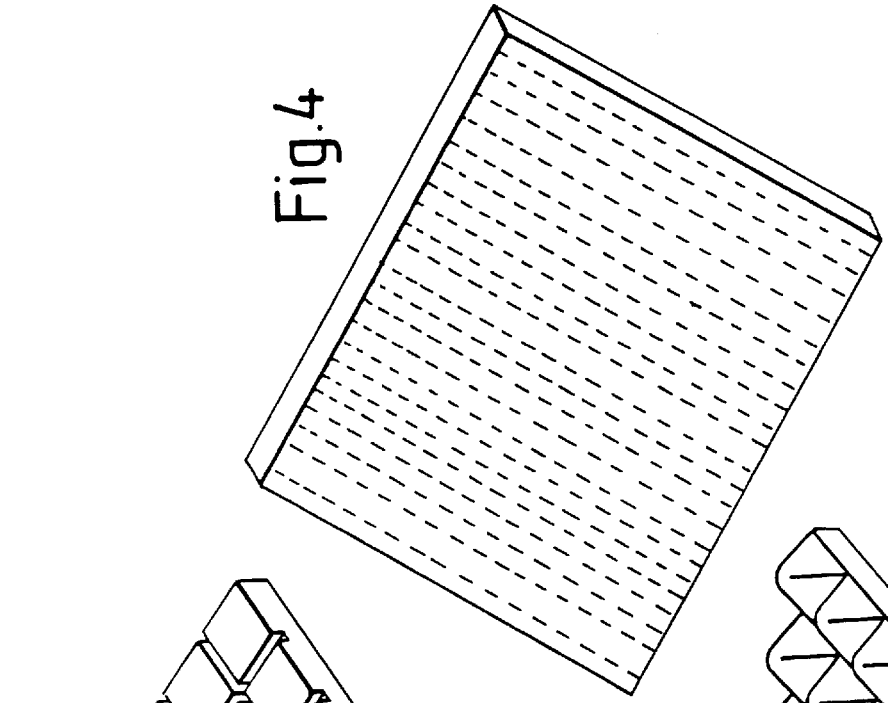
FIGS. 3–6 depict various textures of surfaces used in the apparatus of FIGS. 1 and 2.
Figure 3:
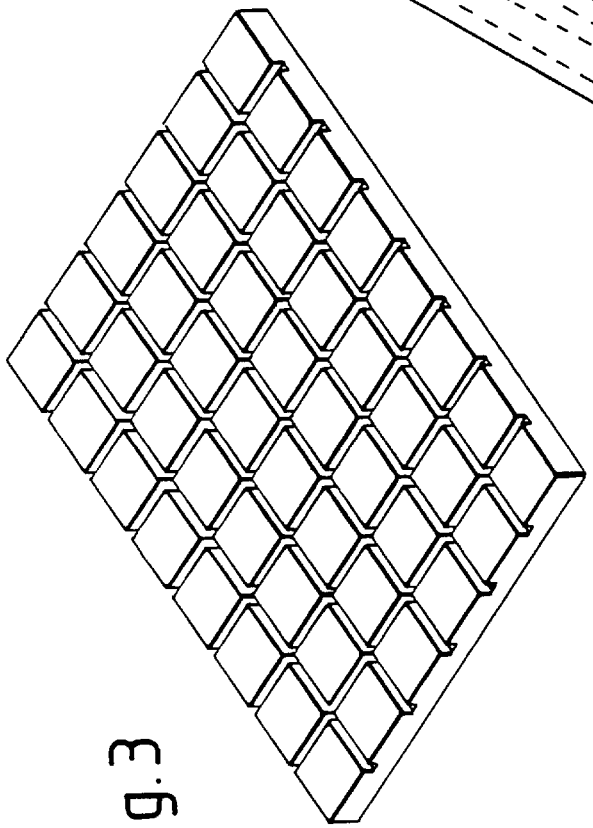
Figure 5:
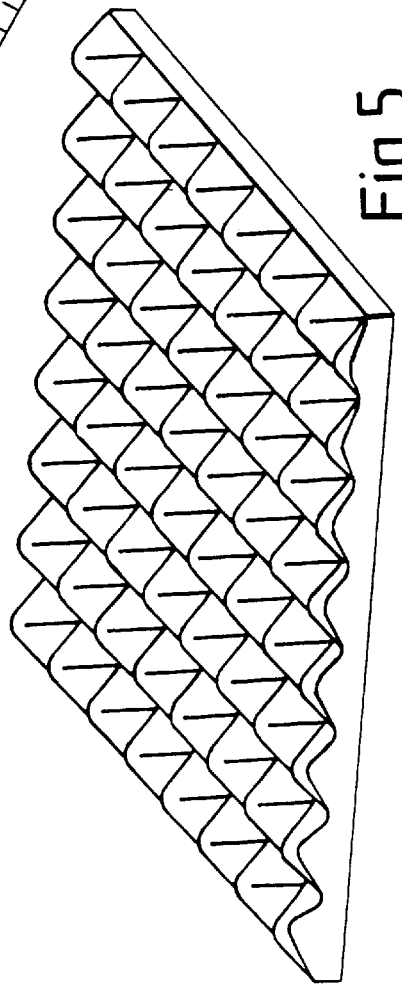
Figure 6:
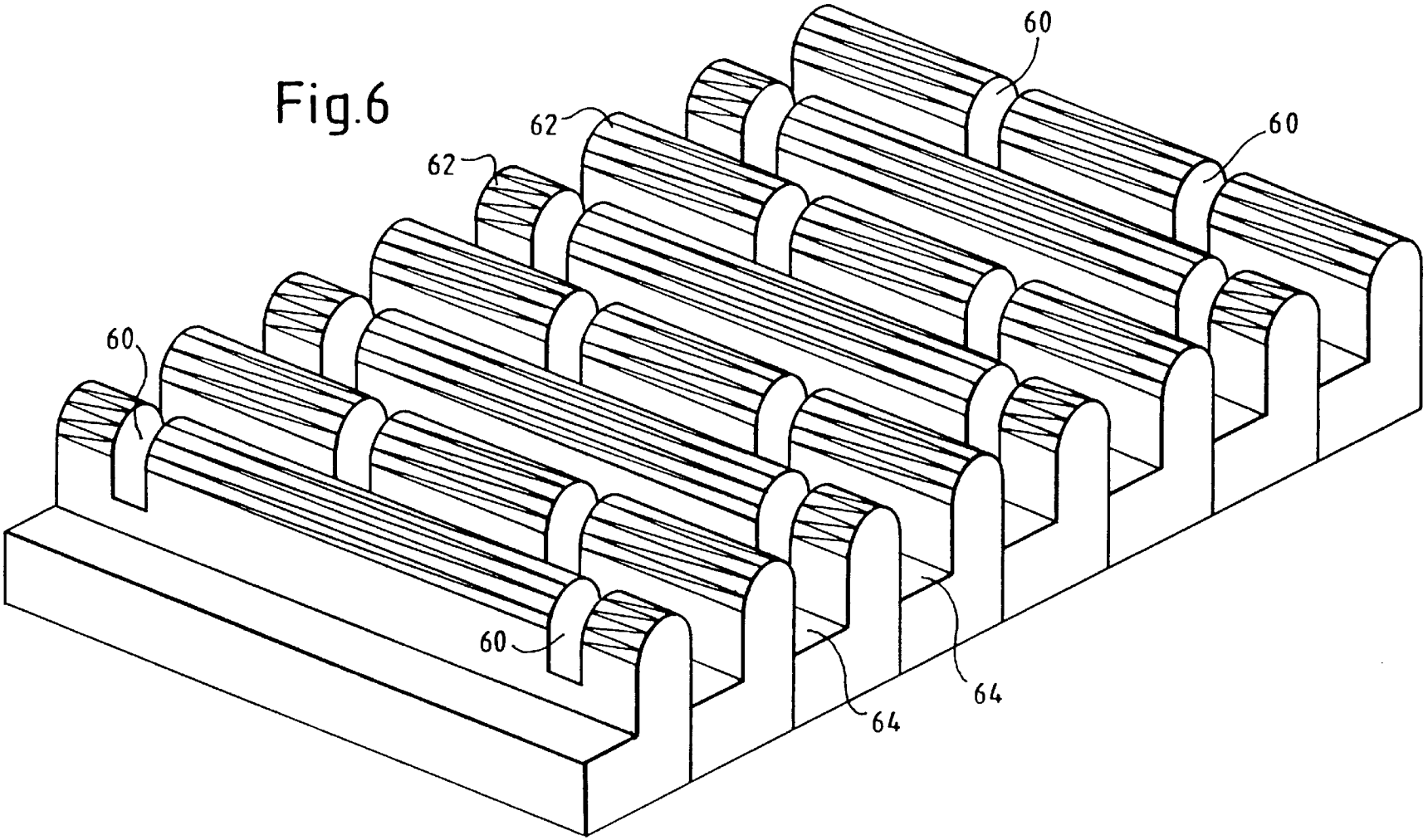

Agitation of the flowing processing solution beneath the moving strip of film can be enhanced by texturing the surfaces of the stages of the apparatus of the invention. FIG. 3 shows one example of this, in which part of an inclined surface is indented orthogonally. FIG. 4 shows a surface with random indentations, and in FIG. 5 the surface has a diamond configuration. Other texturing may be applied. In the enlarged view shown in FIG. 6, slots 60 are cut in transversely-extending ribs 62 of the surface. The depth of the troughs 64 between the ribs 62, the number, frequency and width of the slots 60, and their degree of stagger in successive ribs 62, can all be selected to give the required effect on the flow of the solution in the layer beneath the photographic film 12, as well as on the flow rate of replenisher counter-current to the material.

The overall size of the photographic-processing machine in accordance with the present invention, complete with a printer (not shown) would be about 1 m long and about 1.4 m high, including provision for chemical and waste storage. The total time spent in processing the photographic material, dry-to-dry would be about 100s, when employing variable-time wash processing, compared with about 100s for the wash stage alone in a conventional photographic processor.

It is to be understood that various other changes and modifications may be made without departing from the scope of the present invention, the present invention being limited by the following claims.

What is claimed is:

1. Apparatus for processing photographic material, comprising; a plurality of processing stages, wherein at least one of the stages comprises at least one processing region defined by a curved surface for holding a small volume of processing fluid inclined to the horizontal and disposed between a spaced apart pair of guide means arranged to direct the material through the region over the curved surface; and means for supplying different processing solution to each of the stages, wherein in the or each processing region, the solution is arranged to be applied to the curved surface beneath the material to be processed.

2. Apparatus according to claim 1, wherein each of said stages comprises at least one of said processing regions.

3. Apparatus according to claim 1, wherein the stages in all of said processing regions are inclined uni-directionally, such that subsequent stages are elevated relative to the previous stages.

4. Apparatus according to claim 1, wherein the processing solution of at least one stage having an inclined surface is re-circulated to the upper end of that stage.

5. Apparatus according to claim 1, wherein the photographic material is arranged to be moved upwardly over at least one of the inclined surfaces.

6. Apparatus according to claim 1, wherein processing solution is arranged to flow contrary to the direction of movement of the material in at least one of the stages.

7. Apparatus according to claim 1, wherein at least one of said stages has a processing region that extends substantially horizontally for retaining processing solution in which the photographic material is arranged to be immersed.

8. Apparatus according to claim 1, wherein in at least one of the stages, the length of the inclined surface is longer in the final processing region in the direction of movement of the material than in any one of the preceding regions of that stage.

9. Apparatus according to claim 8, wherein the length of the inclined surface in each of said preceding processing regions is substantially equal.

10. Apparatus according to claim 1, wherein the speed at which the material is driven and the length of the inclined surfaces in the processing regions of at least one stage is such that the residence time of the material in at least one of the regions is less than 10 seconds, and is preferably less than 5 seconds.

11. Apparatus according to claim 1, wherein the speed at which the material is driven and the length of the inclined surfaces in the processing regions of at least one stage is such that the total residence time of the material in that stage is less than 100 seconds, preferably less than 50 seconds, and most preferably not more than 25 seconds.

12. Apparatus according to claim 1, wherein the inclined surface in at least one of the processing regions is textured so as to provide agitation of the processing solution.

13. Apparatus according to claim 1, wherein each guide means comprises a set of rollers through which the photographic material is arranged to pass.

14. A method of processing photographic material, wherein the material is guided through a plurality of processing stages in each of which the material is subjected to a different processing solution, wherein in at least one of stages the material is moved through at least one processing region defined by a curved surface inclined to the horizontal and disposed between a spaced apart pair of guide means that urge the material on to the processing solution flowing over the curved inclined surface.

15. A method according to claim 14, wherein at least one of the stages comprises a plurality of said processing regions and wherein the processing solution is arranged to flow from the upper end of the uppermost surface of said stage over all the surfaces of said stage.

16. A method according to claim 14, wherein the material moves through at least one of the stages in a direction opposite to that of the flow of the processing solution in that stage.

17. A method according to claim 14, wherein the material moves uni-directionally to the horizontal through the stages.

18. A method according to claim 14, wherein the material moves in a generally U- or V-shaped path.

19. A method according to claim 14, wherein the processing stages are selected from a developing stage, a bleach stage, a fixing stage, a bleach-fix stage, and a wash stage.

20. A method according to claim 14, wherein in at least one stage, preferably the wash stage, the time that the material resides in at least one of the processing regions is different from the time it resides in at least one other of the regions.

21. A method according to claim 20, wherein the time that the material resides in the final processing region of said stage in its direction of movement is longer than in any one of the preceding regions.

22. A method according to claim 14, wherein the residence time of the material in at least one of the processing regions in at least one stage, preferably the wash stage, is less than 10 seconds, and is preferably less than 5 seconds.

23. A method according to claim 14, wherein the total residence time of the material in all the processing regions of at least one stage, preferably the wash stage, is less than 50 seconds, preferably less than 30 seconds, and most preferably is not more than 20 seconds.

* * * * *